United States Patent [19]

Knighton et al.

[11] Patent Number: 4,606,416

[45] Date of Patent: Aug. 19, 1986

[54] SELF ACTIVATING, POSITIVELY DRIVEN CONCEALED CORE CATCHER

[75] Inventors: Kelly Knighton, West Jordan; J. Stanley Davis, Sandy; Steven R. Radford, West Jordan, all of Utah

[73] Assignee: Norton Christensen, Inc., Salt Lake City, Utah

[21] Appl. No.: 646,577

[22] Filed: Aug. 31, 1984

[51] Int. Cl.[4] ..... E21B 25/00; E21B 49/02

[52] U.S. Cl. ..... 175/58; 175/250; 175/251

[58] Field of Search ..... 175/20, 58, 226, 244–251, 175/253, 255, 257, 268, 309, 404; 166/318

[56] References Cited

U.S. PATENT DOCUMENTS

| | | | |
|---|---|---|---|
| 1,373,492 | 4/1921 | Dodds | 175/250 X |
| 2,221,392 | 11/1940 | Baker | 175/250 X |
| 2,698,737 | 1/1955 | Dean | 175/251 |
| 3,298,450 | 1/1967 | Sato | 175/226 |
| 3,878,904 | 4/1975 | Dobson | 175/58 X |

*Primary Examiner*—Stuart S. Levy
*Assistant Examiner*—Thomas R. Hannon
*Attorney, Agent, or Firm*—Beehler, Pavitt, Siegemund, Jagger & Martella

[57] ABSTRACT

A core spring type core catcher and a full closure core catcher are completely concealed from the core within a coring tool. The full closure catcher is reliably actuated to assume a closed configuration without dependence upon gravity or an interference diametrical fit with the core by use of a cam ring which is longitudinally displaced downwardly within the core barrel by a preloaded compression spring. The full closure core catcher is comprised of a plurality of flapper valves circumferentially disposed outside of the inner tube and concealed by the inner tube or a terminal extension of the inner tube. Disposed above the plurality of flapper valves, and also circumferentially disposed outside of and concentric with the inner tube is a cam ring. Similarly circumferentially disposed outside of and concentric with the inner tube is a preloaded coil compression spring bearing against the cam ring. The cam ring in turn is in sliding contact with a rear surface of each one of the plurality of flapper valves. When the inner tube is longitudinally displaced with respect to the flapper valves to uncover the flapper valves, the flapper valves are then rotated inwardly within the inner barrel of the coring tool by virtue of the downward longitudinal drive of the cam ring as powered by the preloaded compression spring.

10 Claims, 2 Drawing Figures

14
16
28
12
26
24
18
46
44
52
54
48
50
43
40
42
42
22
36
32
38
34
20
10
30 pression spring to drive a cam mechanism longitudinally downward within the coring tool. The cam mechanism forces the core catcher radially inward into the inner core space of the coring tool. Again, by this combination of steps, the core is cut and disposed within a coring tool without substantial disturbance of the core and the core catcher is activated without dependence upon gravity or diametrical interference fit with the core.

These and other embodiments of the invention can best be understood by now turning to view the following drawings wherein like elements are referenced by like numerals.

DETAILED DESCRIPTION OF THE PREFERRED EMBODIMENTS

The present invention is a self actuating, positively driven concealed core catcher mechanism within a coring tool. A core spring type core catcher and full closure or clam shell type core catcher are concealed behind a terminal extension of an inner tube. The full closure core catcher is actuated, and the flapper valves of the core catcher are driven inwardly into the core barrel space by a spring driven cam. The spring driven cam is preloaded. As the inner tube extension is withdrawn from the dual function catcher, the core spring catcher closes around the core, and the full closure core catcher, which is in contact with the cam, is then free to rotate inward into the core space. The flapper valves are driven inwardly as the cam slides across the rear surface of the flapper valve, thereby positively forcing the flapper valves into a fully closed position. Thus, the full closure catcher is self-actuating, and does not require any physical contact with the core, the action of gravity, or any hydraulic motive force in order to be fully operative.

Figure 1:
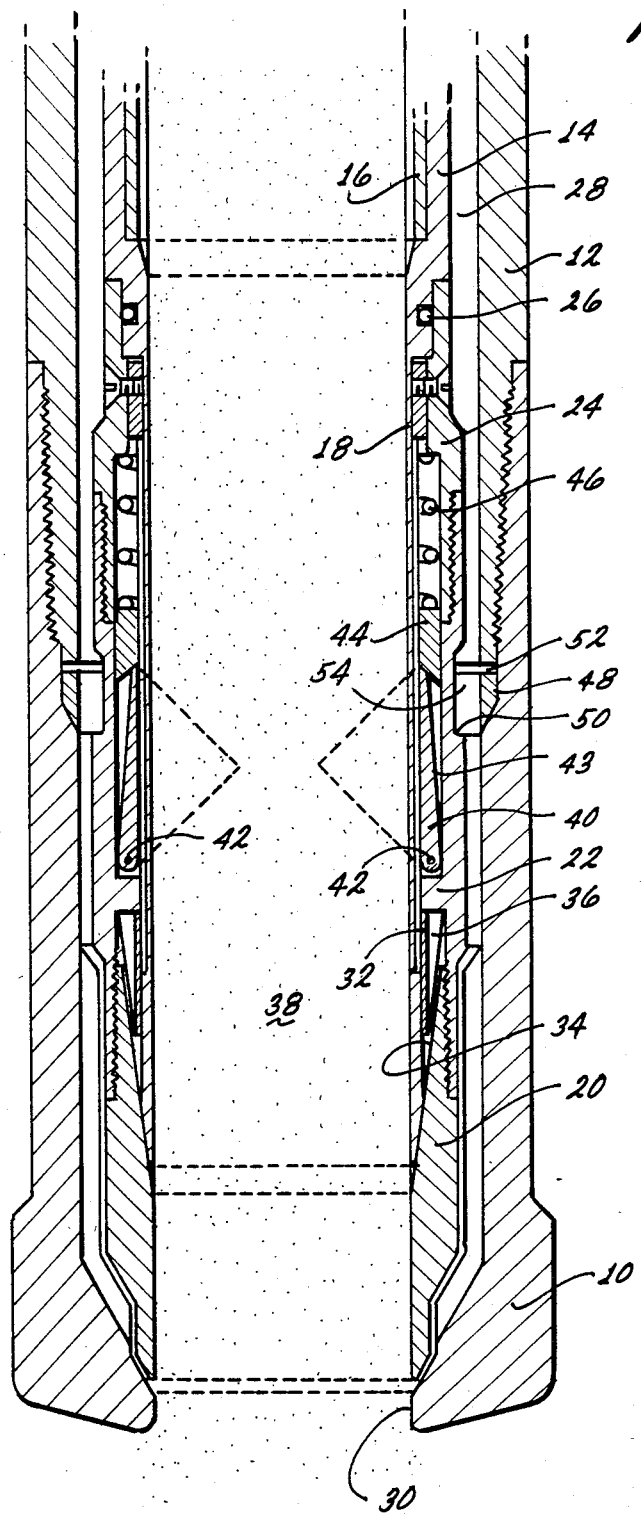
FIG. 1 is a cross-sectional view of a lower part of a coring tool incorporating core catchers according to the invention.

Turn now to FIG. 1, which shows a cross-sectional view of a coring tool incorporating the invention prior to activation. A conventional coring bit 10 is threadably coupled in a conventional manner to an outer tube sub 12. An inner tube is concentrically and telescopically disposed within the outer tube and extends downwardly by means of a sliding inner tube shoe 14. A lower portion of shoe 14 is illustrated in FIG. 1 showing an internal cylindrical plastic liner 16 which snugly and flushly fits within inner tube and inner tube sleeve 14 to provide a smooth interior receiving surface for the core. Inner tube sleeve 14 is extended in a thin cylindrical terminal portion 18 through the remaining lower portion of the coring tool, ultimately contacting an inner tube shoe 20. Inner tube shoe 20 is threadably coupled to a clam shell housing 22, which houses the clam shell or full closure flapper valve assembly, as described below. Clam shell housing 22 in turn is threadably coupled to an upper cylindrical housing 24. Upper housing 24 is concentrically disposed about inner tube sleeve 14 in the upper portion of its cylindrical extension 18, and sealed thereto by conventional O-ring and groove 26. Fluid therefore flows through annular space 28 downwardly within the bit shank, and ultimately through nozzles provided in coring bit 10 and through inner gage 30 of bit 10.

Starting again from the lower portion of the tool, a core spring catcher 32 is disposed above inner tube shoe 20. Core catcher 32 is concentrically disposed outside of cylindrical sleeve 18 and inside of inner tube shoe 20 and clam shell housing 22. An upper interior surface 34 of inner tube shoe 20 provides a frustoconical surface upon which the outside surface 36 of core catcher 32 will ride when core catcher 32 is downwardly displaced with respect to inner tube shoe 20. Core catcher 32 is a conventional split ring resilient core catcher which has been slightly expanded to fit about inner tube sleeve 18. As described below, after inner tube sleeve 18 is lifted and core catcher 32 is uncovered, core catcher 32 will compress about the core disposed within axial space 38 and will thereafter be wedged into the core as core catcher 32 moves downwardly along surface 34.

Figure 2:
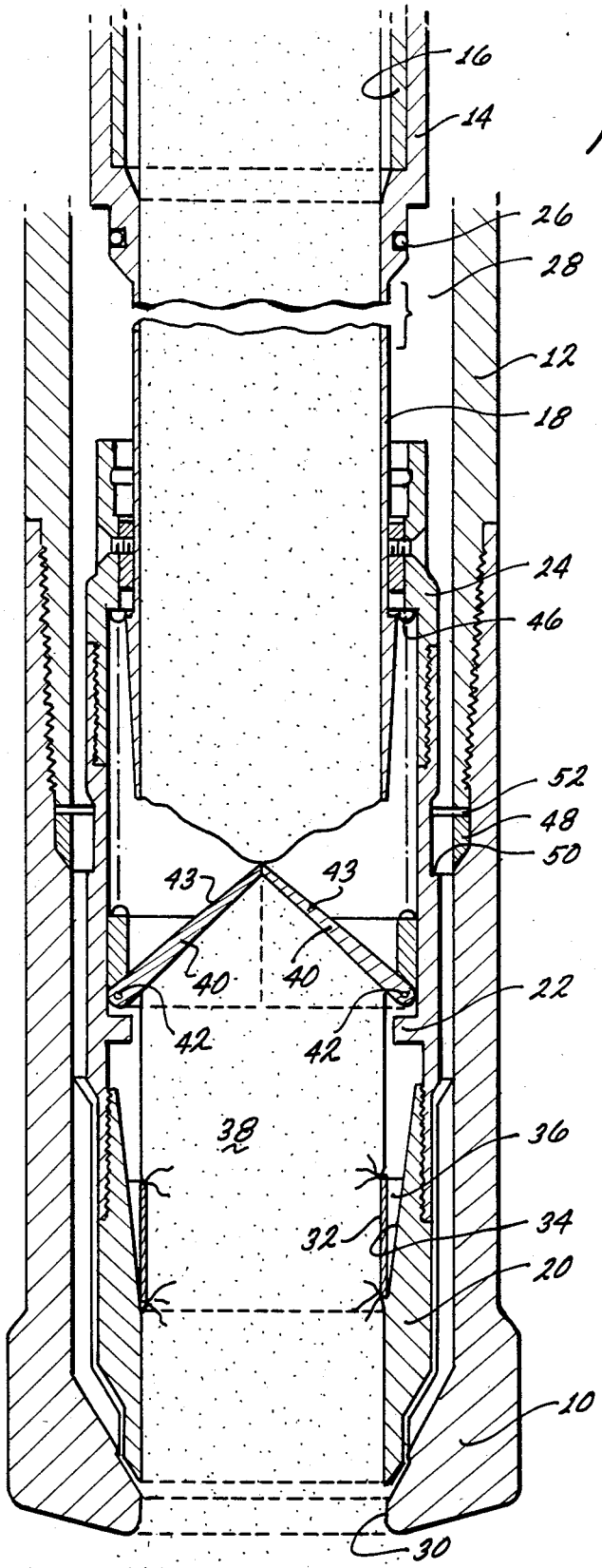
FIG. 2 is a cross-sectional view of the tool of FIG. 1 after the cutting of a core and activation of the core catchers.

Disposed above core catcher 32 and within clam shell housing 22 is a plurality of flapper valves forming the clam shell full closure catcher 40. Flapper valves 40 are cusped and cooperate with each other to rotate inwardly about pivot point 42 to fully close barrel space 38 as best depicted in FIG. 2. A cam 44 is disposed above flapper valve 40, and is arranged and configured to ride on and in contact with rear surface 43 of flapper valve 40. Cam ring 44 is annularly disposed about inner tube sleeve 18, and thus contacts rear surface 43 of each of the flapper valves 40. Cam ring 44 in turn tends to be driven downwardly within the coring tool by means of a compression spring 46, which has been preloaded when the tool is in the open configuration of FIG. 1, but which is allowed to expand thereby forcing flapper valves 40 into closed configuration as shown in FIG. 2.

The various elements of the invention now having been described, its operation may be explained. The coring tool is lowered into the bore hole and drilling begins. As the coring tool cuts into the rock formation, an earth core is disposed in cylindrical axial space 38 and extends upwardly within the inner tube, extending well through terminal extension 18. After the core is cut, the inner tube and sliding inner tube shoe 14 are hydraulically or otherwise pulled upwardly within the coring tool, by means well known in the art, with the inner tube sleeve 14 being longitudinally displaced while the outer tube, including outer tube sub 12, remain longitudinally fixed within the bore hole. A split ring 48 circumferentially disposed about clam shell housing 22 extends inwardly and contacts housing 22 at least at a lower shoulder 50. Split ring 48 is provided with a plurality of openings 54 to permit fluid to flow therethrough during normal operation. If any force tends to pull housing 22 upwardly, split ring 48 is disposed upwardly with housing 22. However, split ring 48 radially extends outward toward outer tube sub 12 by distance sufficient to abut shoulder 52. Thus, any upward longitudinal displacement of housing 22 in its connected elements is prevented by split ring 48 through its coaction with shoulders 50 and 52. Thus, relative longitudinal displacement of terminal extension 18 of the inner tube and the core catcher mechanisms is ensured. When the inner barrel sleeve 18 uncovers core spring 32 it resiliently snaps shut about the core. Inner tube sleeve 18 continues to be pulled upwardly, ultimately uncovering each of the plurality of clam shell flapper valves 40, and thereby allowing cam ring 44 to be driven downwardly by compression spring 46. In the case of a solid rock core, clam shell flapper valves 40

SELF ACTIVATING, POSITIVELY DRIVEN CONCEALED CORE CATCHER

BACKGROUND OF THE INVENTION

1. Field of the Invention

The present invention relates to earth boring tools, and more particularly to core catchers as included within a coring tool.

2. Description of the Prior Art

A coring tool is typically comprised of a toroidally shaped coring bit defined by an outer gage and inner gage. The coring bit cuts a cylindrical core from the rock formation, which core is then disposed through its inner gage and generally aligned with the longitudinal axis of the drill string. The coring bit is typically coupled to a bit shank which is coupled to an outer coring barrel and drill collar, and in turn to a drill pipe, which extends to the ground surface and through which drill pipe the rotary motion is transmitted to the coring bit. Still drilling fluid is forced down through the inside of the drill pipe and ultimately the inner gage of the coring bit, a coring barrel typically includes an outer barrel and one or more inner concentric barrels or sleeves aligned with the longitudinal axis of the drill string which separate the core from the drilling fluid. Once the core is cut, particularly in a consolidated formation, some means is required to break or detach the core from the rock formation from which it extends. The prior art has devised a number of different designs for core catchers which are a collection of wedge shaped, curved segments. Segments collectively form a cylindrical split ring having an internal diameter which frictionally engages the outside surfaces of the core as the barrel is moved downwardly over the core. After the core is cut, the core barrel is pulled upwardly. The core catcher seizes the core and is moved downwardly with respect to the core barrel against an internal frustoconical surface on an inner diameter of the coring tool. Thus, the core catcher becomes wedged between the interior surface of the coring tool and the core. Ultimately, this allows the full tension applied to the drill string to be applied to the core. The core is then broken from the rock formation and retained in the core barrel for retrieval and removal at the surface.

However, the use of such a traditional core catcher is entirely ineffectual in fragmented, loose, sandy or otherwise unconsolidated formations. Firstly, many of such cores need not be broken from their underlying rock formations. Secondly, such traditional rigid core catchers are unable to seize upon the core and wedge it within the core barrel with the result that some or all of the core is lost as the coring tool is tripped from the borehole. In order to overcome these difficulties, the prior art has devised a number of full closure catchers which are typically multiple cusped flapper valves installed in the interior of the core barrel in such a manner that the core is allowed to move upwardly within the core barrel, but upon any downward movement of the core, the flapper valves engage the core and are rotated to a shut or fully closed position. This downward movement is typically gravitationally induced. Thus, even for a sand core the relative downward movement of the sand column relative to the flapper valves causes the flapper valves to dig into the sand core and rotate to provide a full closure of the inner diameter of the core barrel.

However, even with such full closure core catchers the placement of the flapper valves within the core barrel space tends to create an obstruction upon which the core may jam as it is being cut; or provides a means which physically disturbs the original stratification in the core. Obstruction or disturbance of the core are further increased by the use of spring biased flapper valves, which are used at times to increase the reliability of the system.

Therefore, what is needed is a full closure core catcher which overcomes each of the defects of the prior art designs, and in particular, a full closure core catcher which presents no obstacles or opportunities to jam or disturb the core as it is being cut and disposed within the core barrel, but which is reliably and securely driven into a closed position once cutting of the core is finished.

BRIEF SUMMARY OF THE INVENTION

The present invention is a full closure core catcher for use within a coring tool having an inner tube and longitudinal axis. The core catcher comprises a terminal extension of the inner tube extending along the longitudinal axis of the coring tool. A closure mechanism is disposed adjacent the terminal extension for providing full closure of the inner tube. The closure mechanism is capable of assuming an opened and closed configuration. The closure mechanism is also circumferentially disposed radially outside of the terminal extension of the inner tube when the closure mechanism is in the open configuration. The inner tube extension conceals the closure mechanism and maintains the closure mechanism in the open configuration. A cam mechanism provides a substantially longitudinally directed force against the closure mechanism to urge the closure mechanism from the open configuration into the closed configuration. The closure mechanism assumes the closed configuration when the terminal extension of the inner tube is longitudinally displaced with respect to the closure mechanism by a predetermined distance. By reason of this combination of elements a full closure core catcher is provided which is positively actuated when the inner tube is relatively displaced within the coring tool to uncover the previously concealed closure mechanism.

Alternatively, the invention is an improvement in a full closure catcher which is disposed within a coring tool. The tool has a longitudinally displaceable inner barrel. The improvement comprises a plurality of closeable valves disposed outside of the inner sleeve and displaceable within the inner barrel to fully close the inner barrel space. A compression spring-loaded cam mechanism selectively and positively displaces each of the plurality of valves into the core space when the inner barrel and sleeve are longitudinally displaced to unconceal the cam mechanism. By reason of this combination of elements, full closure of the inner barrel is achieved without dependency upon relative descent of the core within the inner barrel.

The invention further includes a method for cutting and disposing of core within a coring tool without substantially disturbing the core. The method comprises the steps of cutting the core, disposing the cut core within a smooth inner tube, longitudinally displacing the inner tube within the coring tool to expose a core catcher and activating the core catcher to retain the core within the coring tool. The step of activating the core catcher is effected by expanding a preloaded comwill simply bear against the rock core, and will not completely close. However, in the case where the core is sandy, loose, unconsolidated or highly fragmented, flapper valves 40 will be driven entirely or at least partially into space 38, thereby entirely or partially closing the axial cylindrical bore space. If flapper valves 40 only partially close, the spring biased cam ring 44 causes the flaper valves 40 to continue to bear on the core and to close later if the core crumbles. Compression spring 46 is substantially less liable to jamming, and is able to provide a significantly greater driving force for the closure of flapper valves 40 than torsion springs, which the prior art typically disposed about the pivot point 42.

Many modifications and alterations may be made by those having ordinary skill in the art without departing from the spirit and scope of the invention. It must be understood that the illustrated embodiment is set forth only by way of example, and should not be taken as limiting the invention as defined in the following claims.

We claim:

1. An improvement in full closure catcher disposed within a coring tool, said tool having a longitudinally displaceable inner barrel, said tool for cutting the core comprising:

a plurality of closable valves disposed outside of said inner barrel and displaceable within said inner barrel space to fully close said inner barrel; and compression spring-loaded cam means for selectively positively displacing each of said plurality of valves into said inner barrel space, when said inner barrel is longitudinally displaced to unconceal said cam means, whereby full closure of said inner barrel is provided without dependency upon relative descent of said core within said inner barrel.

2. An improvement in a full closure catcher disposed within a coring tool, said tool having a longitudinally displaceable inner barrel, said tool for cutting the core comprising:

a plurality of closable valves disposed outside of said inner barrel and displaceable within said inner barrel space to fully close said inner barrel; and compression spring-loaded cam means for selectively positively displacing each of said plurality of valves into said inner barrel space, when said inner barrel is longitudinally displaced to unconceal said cam means, wherein each of said plurality of valves is rotatably coupled to a clam shell housing, said clam shell housing circumferentially disposed outside of and concentric with said inner tube, the longitudinal position of said clam shell housing being at least limited with respect to said outer tube, said plurality of flapper valves being selectively concealed by said inner tube, said flapper valves being circumferentially disposed outside of said inner tube and capable of collectively forming a full closure of said inner barrel;

wherein said compression spring means for positively displacing each of said valves comprises a cam ring circumferentially disposed about said inner tube and concentric therewith, and a coil compression spring circumferentially disposed outside of said inner tube and concentric therewith, said compression spring being disposed in said clam shell housing and preloaded to bear against said cam ring, said cam ring in turn bearing against each of said plurality of valves to urge said valves into full closure, whereby full closure of said inner barrel is provided without dependency upon relative descent of said core within said inner barrel.

3. The improvement of claim 2 wherein said cam ring contacts a longitudinally inclined surface of each of said valves such that longitudinal relative displacement of said cam ring along said inclined surface of said valve causes said valve to be displaced into said inner barrel.

4. The improvement of claim 3 further comprising a split core spring catcher and an inner tube shoe, said split core spring catcher circumferentially disposed outside of said inner tube and concentric therewith, said split core spring catcher being circumferentially disposd inside of said inner tube shoe, said core spring catcher and inner tube shoe having opposing inclined surfaces forming a frustoconical shape, said opposing surfaces of said core spring catcher and inner tube shoe arranged and configured for sliding contact with each other as said split core spring catcher is longitudinally downwardly displaced relative to said inner tube shoe, thereby radially compressing said split core spring catcher.

5. A full closure core catcher for use within a coring tool having an inner tube and longitudinal axis comprising:

a terminal extension of said inner tube extending along said longitudinal axis of said coring tool;

closure means adjacent said terminal extension for providing full closure of said inner tube, said closure means capable of assuming an open and a closed configuration, said closure means circumferentially disposed radially outside of said terminal extension of said inner tube when said closure means is in said open configuration, said inner tube concealing said closure means and retaining said first means in said open configuration; and cam means for providing a substantially longitudinally directed force against said closure means to urge said closure means from said open configuration to said closed configuration, said closure means assuming said closed configuration when said terminal extension of said inner tube is longitudinally displaced with respect to said closure by a predetermined distance, wherein said closure means comprises a plurality of clam shell flapper valves;

wherein said cam means comprises a cam ring and a preloaded compression spring, said cam ring and compression spring circumferentially and concentrically disposed about said terminal extension of said inner tube, said cam ring slidingly contacting said plurality of flapper valves to urge said flapper valves into said closed configuration when said flapper valves are free to rotate by relative longitudinal displacement of said terminal extension of said inner tube with respect to said flapper valves by said predetermined distance, whereby a full closure core catcher is provided which is positively actuated when said inner tube is relatively displaced within said coring tool to uncover said concealed closure means.

6. A full closure core catcher for use within a coring tool having a longitudinal axis comprising:

a terminal extension of said inner tube extending along said longitudinal axis of said coring tool;

closure means adjacent said terminal extension for providing full closure of said inner tube, said closure means capable of assuming an open and a closed configuration, said closure means circumferentially disposed radially outside of said terminal extension of said inner tube when said closure means is in said open configuration, said inner tube concealing said closure means and retaining said first means in said open configuration; and cam means for providing a substantially longitudinally directed force against said closure means to urge said closure means from said open configuration to said closed configuration, said closure means assuming said closed configuration when said terminal extension of said inner tube is longitudinally displaced with respect to said closure by a predetermined distance, wherein said closure means comprises a plurality of clam shell flapper valves;

wherein said cam means comprises a cam ring and a compression spring, said cam ring and compression spring circumferentially and concentrically disposed about said terminal extension of said inner tube, said cam ring slidingly contacting said plurality of flapper valves to urge said flapper valves into said closed configuration when said flapper valves are free to rotate by relative longitudinal displacement of said terminal extension of said inner tube with respect to said flapper valves by said predetermined distance; and further comprising a split core spring circumferentially disposed outside of said terminal extension of said inner tube, and an inner tube shoe circumferentially disposed outside of and concentric with said terminal extension of said inner tube and split core spring, said inner tube shoe and split core spring having mutually contacting surfaces arranged and configured into a frustoconical shape to compress said split core spring radially inward as said split core spring is longitudinally downwardly displaced along said frustoconical surface of said inner tube shoe, whereby a full closure core catcher is provided which is positively actuated when said inner tube is relatively displaced within said coring tool to uncover said concealed closure means.

7. A full closure core catcher for use within a coring tool having a longitudinal axis comprising:

a terminal extension of said inner tube extending along said longitudinal axis of said coring tool;

closure means adjacent said terminal extension for providing full closure of said inner tube, said closure means capable of assuming an open and a closed configuration, said closure means circumferentially disposed radially outside of said terminal extension of said inner tube when said closure means is in said open configuration, said inner tube concealing said closure means and retaining said first means in said open configuration; and cam means for providing a substantially longitudinally directed force against said closure means to urge said closure means from said open configuration to said closed configuration, said closure means assuming said closed configuration when said terminal extension of said inner tube is longitudinally displaced with respect to said closure by a predetermined distance, wherein said closure means comprises a plurality of clam shell flapper valves;

wherein said cam means comprises a cam ring and a compression spring, said cam ring and compression spring circumferentially and concentrically disposed about said terminal extension of said inner tube, said cam ring slidingly contacting said plurality of flapper valves to urge said flapper valves into said closed configuration when said flapper valves are free to rotate by relative longitudinal displacement of said terminal extension of said inner tube with respect to said flapper valves by said predetermined distance; and further comprising a clam shell housing circumferentially disposed outside of and concentric with said terminal extension of said inner tube and radially disposed outside of said plurality of flapper valves, each flapper valve being pivotably coupled to said clam shell housing, said clam shell housing defining a circumferential annular space into which said plurality of flapper valves are disposed when in said open configuration, said compression spring and cam ring similarly disposed within said annular space defined in said clam shell housing, said compression spring being preloaded when said plurality of flapper valves are in said open configuration, one end of said compression spring bearing against said clam shell housing and the opposing end of said compression spring bearing against said cam ring to longitudinally force said cam ring downwardly against said plurality of flapper valves to urge each flapper valve from said open to said closed configuration whenever rotation of said flapper valve about said pivotal coupling with said clam shell housing is possible, whereby a full closure core catcher is provided which is positively actuated when said inner tube is relatively displaced within said coring tool to uncover said concealed closure means.

8. An improvement in a full closure catcher in a coring tool having an inner tube, said full closure catcher configurable in an open configuration and closed configuration, said improvement comprising:

cam means circumferentially disposed outside of said inner tube and concentric therewith, said cam means longitudinally displaceable in said coring tool, said cam means in sliding contact with said full closure core catcher operative to configure said full closure core catcher from said open configuration into said closed configuration; and coil compression spring means circumferentially disposed outside of said inner tube and concentric therewith, said compression spring means generating a longitudinal force within said coring tool, said longitudinal force being applied to said cam means to longitudinally urge said cam means against said full closure core catcher;

wherein said cam means is a freely floating cam ring telescopically disposed outside of said inner tube and concealed by said inner tube, said full closure core catcher similarly being concealed by said inner tube when in said open configuration;

wherein said full closure catcher comprises a plurality of flapper valves, each flapper valve having a rear inclined surface, said cam ring arranged and configured to slidingly contact said rear surface of each said flapper valve, whereby longitudinal displacement of said cam ring with respect to said flapper valve rotates each of said flapper valves into said coring tool.

9. An improvement in a method for retaining a core within a coring tool comprising the steps of:

concealing each core catcher disposed within said coring tool from said core as said core is being cut and disposed into said coring tool;

uncovering each core catcher disposed within said coring tool to permit activation of at least one core catcher; and activating at least one core catcher into at least a partially closed configuration by permitting longitudinal expansion of a preloaded compression spring within said coring tool, said step of activating said core catcher being triggered by said step of uncovering said corresponding core catcher, whereby said at least one core catcher is reliably activated within said coring tool without dependence upon gravity or diametrical interference fit with said core, and whereby said core is disposed within said coring tool without obstruction or disturbance within said coring tool without obstruction or disturbance by any core catcher;

where said step of activating said at least one core catcher comprises the step of driving a cam ring longitudinally within said coring tool against a plurality of flapper valves, said cam ring being disposed circumferentially outside said plurality of flapper valves, a surface contact between said cam ring and flapper valves forming a frustoconical shape whereby said longitudinal movement of said cam ring rotates each one of said plurality of flapper valves into said tool into a closed configuration.

10. A method for cutting and disposing a core within a coring tool without substantial disturbance of said core comprising the steps of:

cutting said core;

disposing said cut core within a smooth inner tube;

longitudinally displacing said inner tube within said coring tool to expose a core catcher; and activating said core catcher to retain said core within said coring tool, wherein said step of activating said core catcher is by expanding a preloaded compression spring to drive a cam means longitudinally downward within said coring tool, said cam means forcing said core catcher radially inward into the inner barrel of said coring tool, where said step of activating said core catcher is comprised of the step of fully uncovering said core catcher to permit said core catcher to assume a preferred fully closed configuration, said fully closed configuration being a biased configuration of said core catcher;

where said step of activating said core catcher is further comprised of the step of fully uncovering a split spring core catcher to permit said split spring to assume a preferred configuration of diametrical interference contact between said split spring core catcher and said core, said split spring core catcher and full closure core catcher being concealed prior to activation, whereby a core is cut and disposed within a coring tool without substantial disturbance of said core and said core catcher is activated without dependence upon gravity or diametrical interference fit with said core.

* * * * *